US009611857B2

(12) United States Patent
Giove et al.

(10) Patent No.: US 9,611,857 B2
(45) Date of Patent: Apr. 4, 2017

(54) DEAD TIME REDUCER FOR PISTON ACTUATOR

(71) Applicant: Control Components, Inc., Rancho Santa Margarita, CA (US)

(72) Inventors: Fabio Giove, Gioia del Colle (IT); Flavio Tondolo, Stezzano (IT); Marco Mastrovito, Gioia del Colle (IT)

(73) Assignee: Control Components, Inc., Rancho Santa Margarita, CA (US)

( * ) Notice: Subject to any disclaimer, the term of this patent is extended or adjusted under 35 U.S.C. 154(b) by 374 days.

(21) Appl. No.: 14/261,106

(22) Filed: Apr. 24, 2014

(65) Prior Publication Data

US 2015/0308442 A1 Oct. 29, 2015

(51) Int. Cl.
*F04D 27/02* (2006.01)

(52) U.S. Cl.
CPC ..... *F04D 27/0223* (2013.01); *F04D 27/0215* (2013.01); *F05D 2270/3011* (2013.01); *F05D 2270/3013* (2013.01)

(58) Field of Classification Search
CPC ..... F04D 27/0215; F04D 27/0223; F05D 2270/3011; F05D 2270/3013
See application file for complete search history.

(56) References Cited

U.S. PATENT DOCUMENTS 5,242,263 A 9/1993 Mondoloni
5,385,012 A 1/1995 Rowe
5,798,941 A * 8/1998 McLeister ..... G05B 11/42 415/1
5,951,240 A 9/1999 Mirsky et al.
6,732,629 B1 5/2004 Miller et al.
6,802,242 B1 10/2004 Steinke et al.
6,935,107 B2 8/2005 Tondolo et al.
8,201,580 B2 6/2012 Tondolo et al.
8,301,275 B2 10/2012 Tondolo et al.
8,517,335 B2 8/2013 Tondolo et al.
8,522,818 B2 9/2013 Tondolo et al.
9,091,274 B2 * 7/2015 Galeotti ..... F04D 27/001
2009/0127485 A1 5/2009 Wessel et al.
(Continued)

OTHER PUBLICATIONS

International Search Report and Written Opinion for PCT/US2015/026943. Issued Jul. 13, 2015.

*Primary Examiner* — Jesse Bogue
(74) *Attorney, Agent, or Firm* — Stetina Brunda Garred and Brucker; Mark Garred

(57) ABSTRACT

An anti-surge system capable of anticipating a surge event in a compressor for readying the actuator to quickly actuate the anti-surge valve from the closed position to the open position. The control system includes a compressor surge controller configured to transmit a signal to the valve positioner when the operating point of the valve is approaching the surge control line. The compressor surge controller may monitor an operating margin equal to the difference between the operating point and the surge control line, and when the operating margin falls below a prescribed threshold, the compressor surge controller may send a signal to the positioner. In turn, the positioner may vent some pressure from the actuator. In this way, the dead time of the anti-surge valve on the valve seat is minimized and the valve will react more promptly to an opening signal.

19 Claims, 7 Drawing Sheets

(56) References Cited

U.S. PATENT DOCUMENTS

| | | | | |
|---|---|---|---|---|
| 2009/0274565 | A1* | 11/2009 | White | F04D 27/0215 417/282 |
| 2012/0103426 | A1 | 5/2012 | Galeotti | |
| 2013/0174915 | A1 | 7/2013 | Tondolo et al. | |
| 2013/0333365 | A1* | 12/2013 | Silet | F01D 17/06 60/327 |
| 2014/0069096 | A1* | 3/2014 | Murayama | F02B 37/16 60/611 |
| 2015/0047340 | A1* | 2/2015 | Ulrey | F02B 47/08 60/600 |
| 2015/0047346 | A1* | 2/2015 | Styles | F02B 47/08 60/605.2 |

* cited by examiner

DEAD TIME REDUCER FOR PISTON ACTUATOR

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates generally to control systems for a compressor, and more particularly, to an anti-surge valve configured to anticipate surge conditions for purposes of reducing valve dead time on a valve seat when action is required by a compressor controller.

2. Description of the Related Art

Compressors are frequently employed in many industrial applications. One of the primary concerns associated with the operation of a compressor is compressor surge, which typically occurs in a centrifugal or axial compressor when the inlet flow is reduced to an extent such that the compressor, at a given speed, can no longer pump against the existing pressure head.

The occurrence of compressor surge may induce a reversal of gas flow through the compressor, which may be accompanied with a drop in pressure head. Eventually, normal compression resumes, although the cycle typically repeats. The occurrence of cyclical surge events may cause pulsation and shock to the entire compressor and pipe arrangement. If left uncontrolled, damage to the compressor could result.

In view of the undesirable conditions associated with compressor surge, many compressor systems include a bypass valve (e.g., an anti-surge valve), which may reroute gas flow around the compressor or exhaust gas to the atmosphere when compressor surge is imminent so as to maintain minimum flow through the compressor. During normal compressor operation, the bypass valve may remain closed. However, as the surge conditions arise, the bypass valve may selectively open with the aim of ultimately avoiding compressor surge.

The movement of most bypass valves is governed by an actuator, which provides the motive force to open and close the valve element. The actuator may also provide an additional force when the valve is in a closed position to keep the valve sealed tight so as to mitigate leakage between the upstream and downstream flows relative to the valve. The actuator may employ pneumatic, hydraulic, electrical, or mechanical energy for moving the bypass valve between the closed and open positions.

A conventional pneumatic actuator is comprised of a piston sealed within a cylinder, the piston including a connecting rod that is mechanically coupled to the valve element. Compressed gas is forced into and out of the cylinder to move the connecting rod, which is mechanically coupled to the stem of the control valve. In a single-acting actuator, the compressed gas is taken in and exhausted from one end of the cylinder and is opposed by a range spring, while in a double-acting actuator, air is taken in one end of the cylinder while simultaneously exhausting it out of the opposing end.

Precise and accurate control of the valve actuator, and hence the valve element, can be achieved with a positioner device coupled thereto. Pneumatic valve positioners, which can cooperate with the aforementioned pneumatic actuators, are well known in the art. The proportional movement of the actuator may be accomplished by the movement of compressed gas into and out of the actuator piston. More particularly, conventional valve positioners incorporate a spool (or other devices) that either rotates or slides axially in a housing to port the flow of compressed gas to the actuator or to one or more exhaust ports.

An electrical control circuit may provide a variable current signal to the positioner device that proportionally corresponds to particular states of the actuator and hence a particular position of the control valve. The electrical control circuit and the electrical current signals generated thereby may be part of a broader process managed by a distributed control system (DCS). Generally, the electrical current varies between 4 milliamperes (mA) and 20 mA according to industry-wide standards; at 4 mA, the valve positioner may fully open the valve element, while at 20 mA, the valve positioner may fully close the valve element (or the opposite, according to the logic control of the plant). The positioner compares the received electrical signal to the current position of the actuator, and if there is a difference, the actuator is moved accordingly until the correct position is reached.

Typically, between the positioner and the actuator, there is a safety shut down/trip system, which is generally piloted by a solenoid valve (SOV). The safety shut down/trip system typically operates to drive the valve to the fully open position, as fast as possible, when the SOV is de-energized, regardless of the positioner signal/action. It is industry practice that the SOV drives 3-way pneumatically operated valves to perform the fast stroke required by the trip signal. Generally, the stroking time required in opening the SOV is less than or equal to the stroking time required under controlled opening.

A common deficiency associated with conventional anti-surge control systems is that there is a delay (e.g., dead time) associated with moving the valve from its closed position to its incipient open position. With the term "stroking time," reference is made instead to the overall time the valve takes to reach its fully open position, starting from a closed position, when the opening signal is given to the valve. Along these lines, when the conditions which trigger movement from the closed position to the open position are detected, pressure within the actuator must be discharged before valve movement is to occur. This delay is typically due to the additional force given by the actuator, necessary to guarantee tightness between the plug and the seat of the valve. In this respect, the venting of such pressure from the valve actuator prevents immediate movement of the valve.

With reference to FIG. 1, in the current state of the art, the controller of the compressor typically provides a proportional signal to open the valve when an action of flow recycling is needed. Such a signal is typically the result of the combination of a Proportional+Integral signal 2 (generally smooth) and a recycle trip action 4 that is normally a step response. In reality, due to the delay of the response of the antisurge valve to a smooth and proportional signal (the discharge of the pressure of the actuator is not immediate), there is no real action of the valve until a recycle trip action is given to the valve. In that case, the control of the operating point may not be accurate. Avoidance of the action trip 4 may result in better performance of control and avoidance of loss of production.

It is current practice to take some safety margin to avoid trip occurrence. This is often done by establishing an ideal Surge Control Line (SCL) which separates itself from the Surge Limit Line (SLL) which is the line at which the surge is expected to occur. The higher the distance between the SCL and SLL, the higher the safety of compressor operation, but at a price of greater inefficiencies, since a part of the compressor map showing good efficiency cannot be used.

Accordingly, there is a need in the art for an improved anti-surge valve that is capable of reducing dead time of the piston actuator when surge conditions occur.

BRIEF SUMMARY OF THE INVENTION

In accordance with one embodiment of the present invention, there is provided a control system for an anti-surge valve that is capable of anticipating the recycle trip action or a surge event in a compressor for readying the actuator to quickly respond to a proportional actuation signal from a valve positioner when the control system determines that the anti-surge valve should be moved from the closed position to the open position.

According to one implementation of the invention, there is provided an antisurge control system for a compressor having a compressor inlet and a compressor outlet, wherein the compressor experiences compressor surge in response to defined operational conditions. The antisurge control system includes a surge controller operatively connectable to the compressor and configured to monitor operation of the compressor and generate an antisurge signal when compressor operational conditions exceed a prescribed threshold associated with compressor surge. An antisurge valve is in operative communication with the surge controller and is fluidly connectable to the compressor inlet and compressor outlet. The antisurge valve is selectively transitional between a closed position and an open position, wherein the antisurge valve is transitioned from the closed position to the open position to enable fluid flow from the compressor outlet to the compressor inlet through the antisurge valve. A valve actuator is operatively coupled to the surge controller and the antisurge valve. The valve actuator is configured to exert a first closing force on the antisurge valve for closing the antisurge valve. The valve actuator is further configured to exert a second closing force equal to only a portion of the first closing force on the antisurge valve in response to receiving the antisurge signal from the surge controller, wherein the second closing force is sufficient to prevent the antisurge valve from transitioning to the open position.

The first closing force may be a summation of an internal valve force, a seating force and an actuator biasing force. The internal valve force may be associated with the fluid pressure inside the antisurge valve biasing the antisurge valve toward the open position. The seating force may be associated with the pressure required to mitigate flow leakage through the antisurge valve. The actuator biasing force may be associated with a force biasing the actuator toward a position corresponding to the open position of the antisurge valve. The difference between the first closing force and the second closing force may be substantially equal to the seating force.

A flow transmitter may be operatively coupled to the surge controller and fluidly connectable with at least one of the compressor inlet and compressor outlet. The flow transmitter may be configured to monitor fluid flow through the compressor and transmit corresponding flow data to the surge controller.

A valve inlet pressure sensor may be operatively coupled to the surge controller and fluidly connectable with the compressor inlet. The valve inlet pressure sensor may be configured to monitor fluid pressure at the compressor inlet and transmit corresponding inlet pressure data to the surge controller.

A valve outlet pressure sensor may be operatively coupled to the surge controller and fluidly connectable with the compressor outlet. The valve outlet pressure sensor may be configured to monitor fluid pressure at the compressor outlet and transmit corresponding outlet pressure data to the surge controller.

The valve actuator may include an actuator chamber and an actuator piston reciprocally moveable within the actuator chamber, wherein movement of the actuator piston corresponds to transitioning of the antisurge valve between the closed and open positions. The valve actuator may include a spring operatively coupled to the piston to urge the piston toward a position corresponding to the open position of the antisurge valve.

A valve positioner may be in operative communication with the valve actuator and the surge controller. The valve positioner may be configured to modify pressure with the actuator chamber for moving the actuator piston.

In one embodiment, the control system includes a compressor surge controller that transmits an anticipation signal to the valve positioner when the operating point of the valve is approaching the surge control line. This signal may be, for example, a simple open/closed circuit signal, but also may be a wireless signal, digital signal, or even whatever variation of the 4-20 mA control signal of the valve. In this last case, it may be any variation of this signal around a certain position, or either a variation of the signal around the cutoff threshold.

The compressor surge controller may monitor an operating margin equal to the distance between the operating point and the surge control line (SCL) on a compressor map. When the operating margin falls below a prescribed threshold, the compressor surge controller may send a signal (different from the control signal that is still fully closed) to the positioner.

The positioner acquires the signal and operates to change the pressures in the actuator shifting from full thrust on seat to a situation where the thrust is reduced or fully removed or the plug is floating very close to the seat. One among the three different above scenarios can be selected depending on the specific application, and proper positioner parameters can be calibrated accordingly.

From this situation, with the actuator ready to move, the valve will react more promptly to an opening signal (fully open by SOV or control by signal) and the dead time on the seat will become very low, and thus, the total time to complete the stroke or control step is shorter.

According to another embodiment, there is provided a method of controlling a surge in a compressor. The method includes the steps of: providing an antisurge valve in fluid communication with a compressor inlet and a compressor outlet, monitoring operation of the compressor and identifying an anticipated surge condition when compressor operational conditions exceed a prescribed threshold associated with compressor surge. The method further includes exerting a closing force on the antisurge valve so as to maintain the antisurge valve in the closed position during normal operation of the compressor. The method additionally includes the step of reducing the closing force by an amount in response to identification of the anticipated surge condition, the reduced closing force being sufficient to prevent the antisurge valve from transitioning to the open position.

The reducing step may include venting pressure from an actuator chamber.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION OF THE INVENTION

The detailed description set forth below in connection with the appended drawings is intended as a description of certain embodiments of control system for an anti-surge valve and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Figure 1:
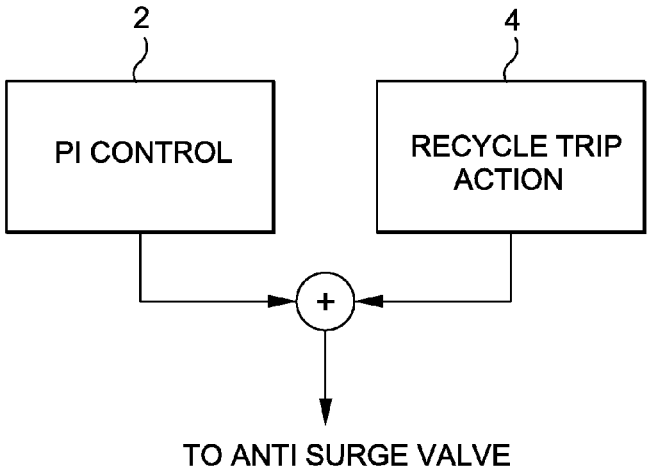
FIG. 1 (Prior Art)
FIG. 1 is a block schematic of standard control loop for an antisurge valve.
Figure 2:
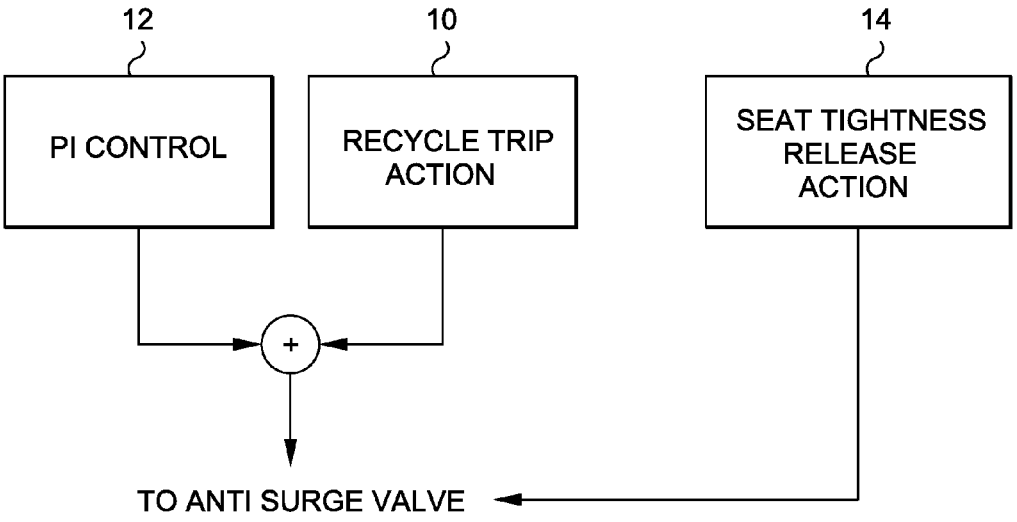
FIG. 2 is a block schematic with the seat tightness release signal.

As will be described in detail below, various aspects of the present invention relate to a control system for an antisurge valve that is capable of anticipating the recycle trip action 10 (see FIG. 2) or a surge event in a compressor for readying the actuator to quickly respond to a proportional actuation signal 12 from a valve positioner when the control system determines that the anti-surge valve should be moved from the closed position to the open position. In one embodiment, the control system includes a compressor surge controller that transmits an anticipation signal to the valve positioner when the operating point of the valve is approaching the surge control line. The compressor surge controller may monitor an operating margin equal to the difference between the operating point and the surge control line. When the operating margin falls below a prescribed threshold, the compressor surge controller may send a signal 14 to the positioner. Such signal, may be, for example, a simple open/closed circuit signal, but also may be a wireless signal, digital signal, or even whatever variation of the 4-20 mA control signal of the valve. In this last case, it may be any variation of this signal around a certain position, or either a variation of the signal around the cutoff threshold. As such, the signal may have different modes to be sent to the positioner, but substantially communicates to the positioner of the valve, that the operating margin is below the prescribed threshold. In turn, the positioner may vent some pressure from the actuator. The dead time of the anti-surge valve on the valve seat is minimized and the valve will react more promptly to an opening signal. The present invention will be best understood by reference to the following detailed description when read in conjunction with the accompanying drawings.

Figure 3:
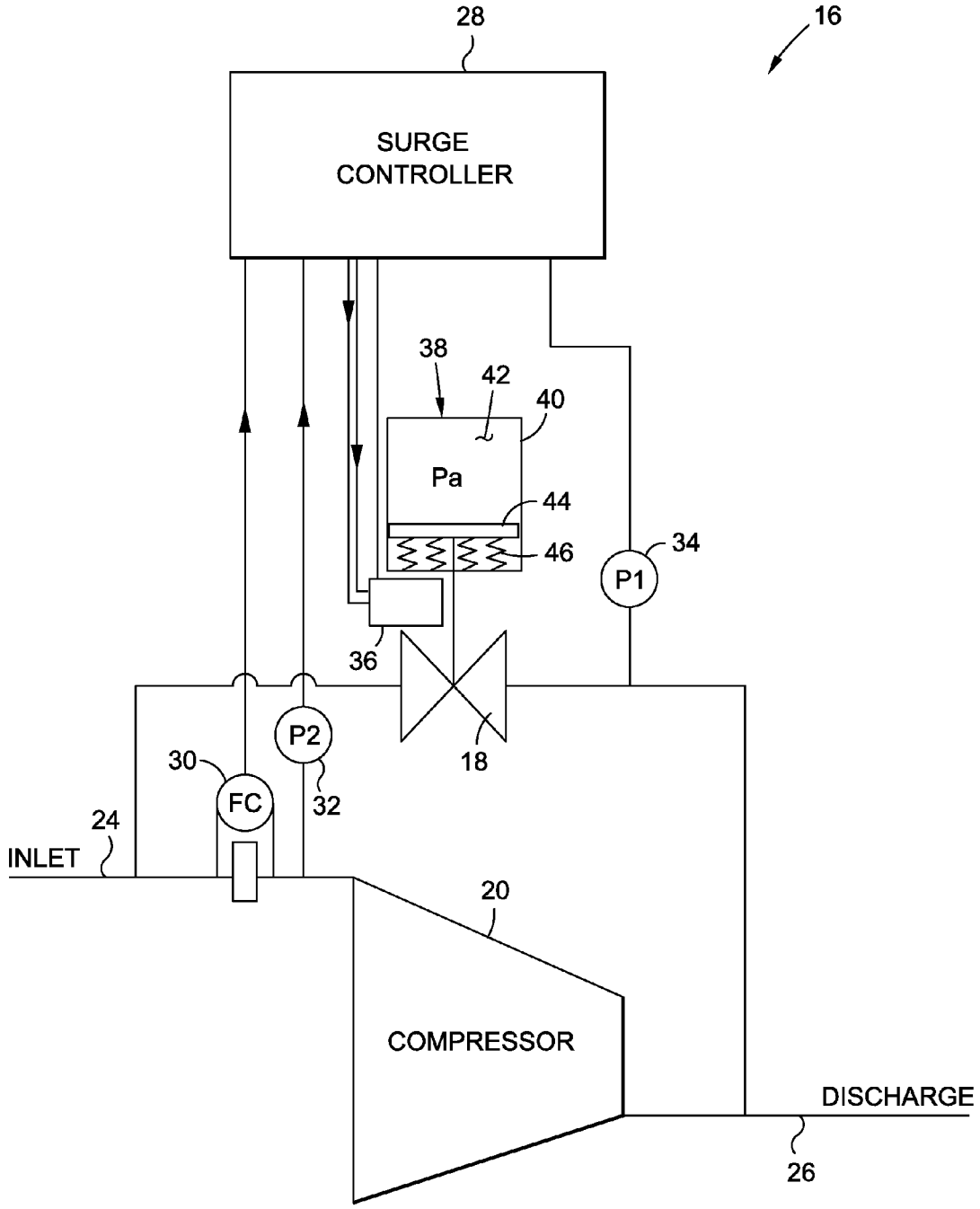
FIG. 3 is a schematic view of one embodiment of a surge control system having a dead time reducer in communication with a valve actuator.

Referring now to FIG. 3, there is depicted a schematic diagram which generally illustrates a control system 16 for an anti-surge valve 18 operative to reduce surge on an industrial compressor 20. As used herein, the term "surge" refers to a condition when the amount of gas the compressor 20 is attempting to compress is insufficient for the speed of the compressor 20. In such instances, the turbine blades tend to lose their forward thrust, which may cause a reverse movement in the compressor shaft, which may, in turn, have catastrophic effects on the compressor 20 such as the expulsion of compressed gas from the inlet.

Figure 4:
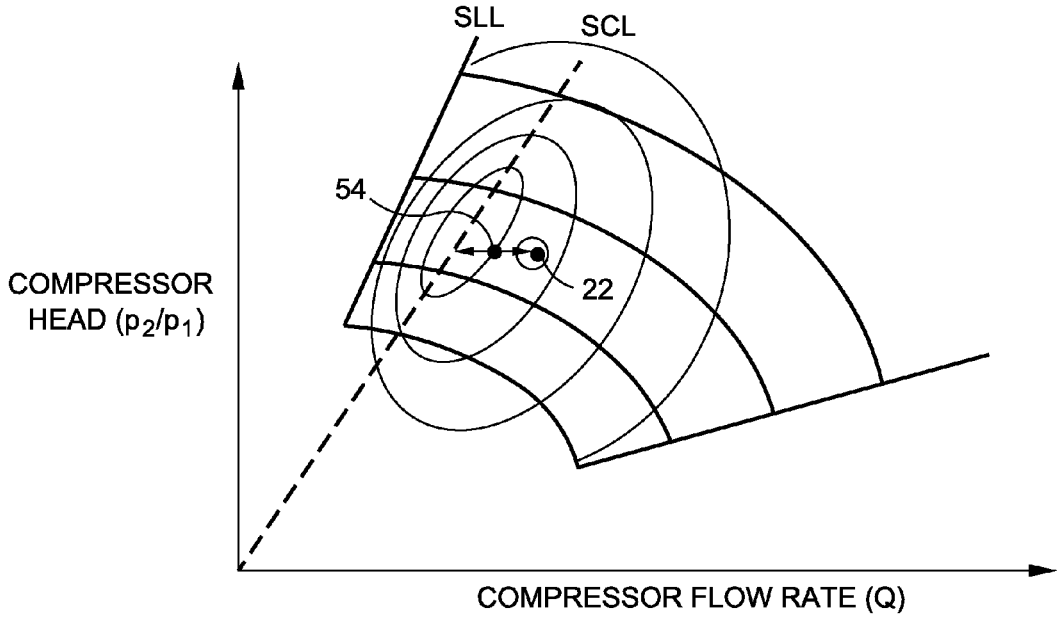
FIG. 4 is a graphical depiction of a compressor map for the control system depicted in FIG. 3.

FIG. 4 is a graphical depiction of a compressor map depicting the output/signal versus time for a compressor surge controller constructed in accordance with an embodiment of the present invention. Surge typically occurs when the operative point 22 in FIG. 4 crosses the surge limit line (SLL).

During normal operation of the compressor 20, gas that is to be compressed is fed to the compressor 20 via a compressor inlet 24 and the compressed gas exits the compressor 20 via a compressor discharge 26. To protect against a reverse flow through the compressor 20 in the event of compressor surge, the control system 16 includes an anti-surge valve 18 in fluid communication with the compressor inlet 24 and compressor outlet/discharge 26. The anti-surge valve 18 is transitioned from a normally closed position during normal operation of the compressor 20 (e.g., when gas flows through the compressor 20 from the compressor inlet 24 to the compressor outlet/discharge 26), to an open position when the compressor 20 approaches its surge limit. When the anti-surge valve 18 is opened, fluid flows through the anti-surge valve 18 from the compressor discharge/outlet 26 to the compressor inlet 24, so as to reroute the fluid around the compressor 20, rather than having the fluid flow through the compressor 20 in a reverse direction.

Various aspects of the present invention are directed toward anticipating the transition of the anti-surge valve 18 from the closed position to the open position so as to reduce the delay or dead time associated with opening of the anti-surge valve 18.

To that end, the control system 16 includes a surge controller 28 for controlling the opening and closing of the anti-surge valve 18. The surge controller 28 processes information received from a flow transmitter 30, a valve outlet pressure sensor 32 and a valve inlet pressure sensor 34 for determining the appropriate position of the anti-surge valve 18. The flow transmitter 30 measures gas flow through the compressor 20 and may include various flow meters known by those skilled in the art. The valve outlet and inlet pressure sensors 32, 34 measure the gas pressure at the valve outlet and inlet, respectively, and may include pressure sensing equipment known in the art. The flow transmitter 30, valve outlet pressure sensor 32 and valve inlet pressure sensor 34 are all preferably capable of generating electrical signals for transmission to the surge controller 28. Communication between the surge controller 28 and the flow transmitter 30, valve outlet pressure sensor 32 and valve inlet pressure sensor 34 may be made by wired or wireless communication modalities.

The surge controller 28 is additionally in operative communication (e.g., wired or wireless communication) with a valve positioner 36, which in turn, is in operative communication with an anti-surge valve actuator 38, which is configured to provide the motive force for opening and closing the anti-surge valve 18.

According to one embodiment, the anti-surge valve actuator 38 includes an actuator housing 40 defining an internal chamber 42. A piston 44 resides within the internal chamber 42 and reciprocates within the internal chamber 42 to effectuate opening and closing of the anti-surge valve 18. The piston 44 is acted upon in a first direction by actuator spring 46, and in an opposing second direction by a pressurized chamber having a variable pressure, $P_a$. When it is desired to move the piston 44 in the first direction (i.e., toward the top of the page in the perspective shown in FIG. 3), the pressure $P_a$ is decreased, such that the force of the springs 46 is greater than the opposing force created by the pressure $P_a$, which in turn, allows for movement of the piston 44 in the first direction. Conversely, if it is desired to move the piston 44 in the second direction (i.e., toward the bottom of the page in the perspective shown in FIG. 3), the pressure $P_a$ is increased, such that the force created by pressure $P_a$ overcomes the force of the springs 46 plus additional forces coming from the valve stem, which in turn, allows for movement of the piston 44 in the second direction. Thus, the piston 44 may reciprocally move within the internal chamber 42 in the opposing first and second directions by selectively varying the pressure $P_a$. One or more fluid ports may be in communication with the internal chamber 42 for selecting porting/venting fluid into and out of the internal chamber 42.

The anti-surge valve actuator 38 shown in the schematic of FIG. 3 is a single-acting actuator (i.e., a single pneumatic input to vary the pressure $P_a$) with spring return; however, it is also contemplated that the anti-surge valve actuator 38 may be of a double-acting type including a pair of pneumatic inputs on opposed sides of the piston head for controlling movement of the piston 44. In this respect, the piston 44 may divide the internal chamber 42 into fluidly separated sub-chambers, which have separate pressures respectively associated therewith. The pressures of the sub-chambers may be selectively varied by supplying pressurized fluid therein to increase the pressure, or venting fluid therefrom to decrease the pressure to achieve the desired pressure differential between the sub-chambers for purposes of moving the piston in the desired direction.

The supplying and exhausting of the pressurized fluid to the anti-surge valve actuator 38 is governed by the valve positioner 36. The basic function of the valve positioner 36 involves the selective porting of pressurized fluid to the pneumatic input associated with the internal chamber 42. The volume of pressurized fluid flowing from the anti-surge valve actuator 38 depends on an external input, which according to one embodiment, is a valve position signal provided to the valve positioner 36 over a wire connection.

Figure 5:
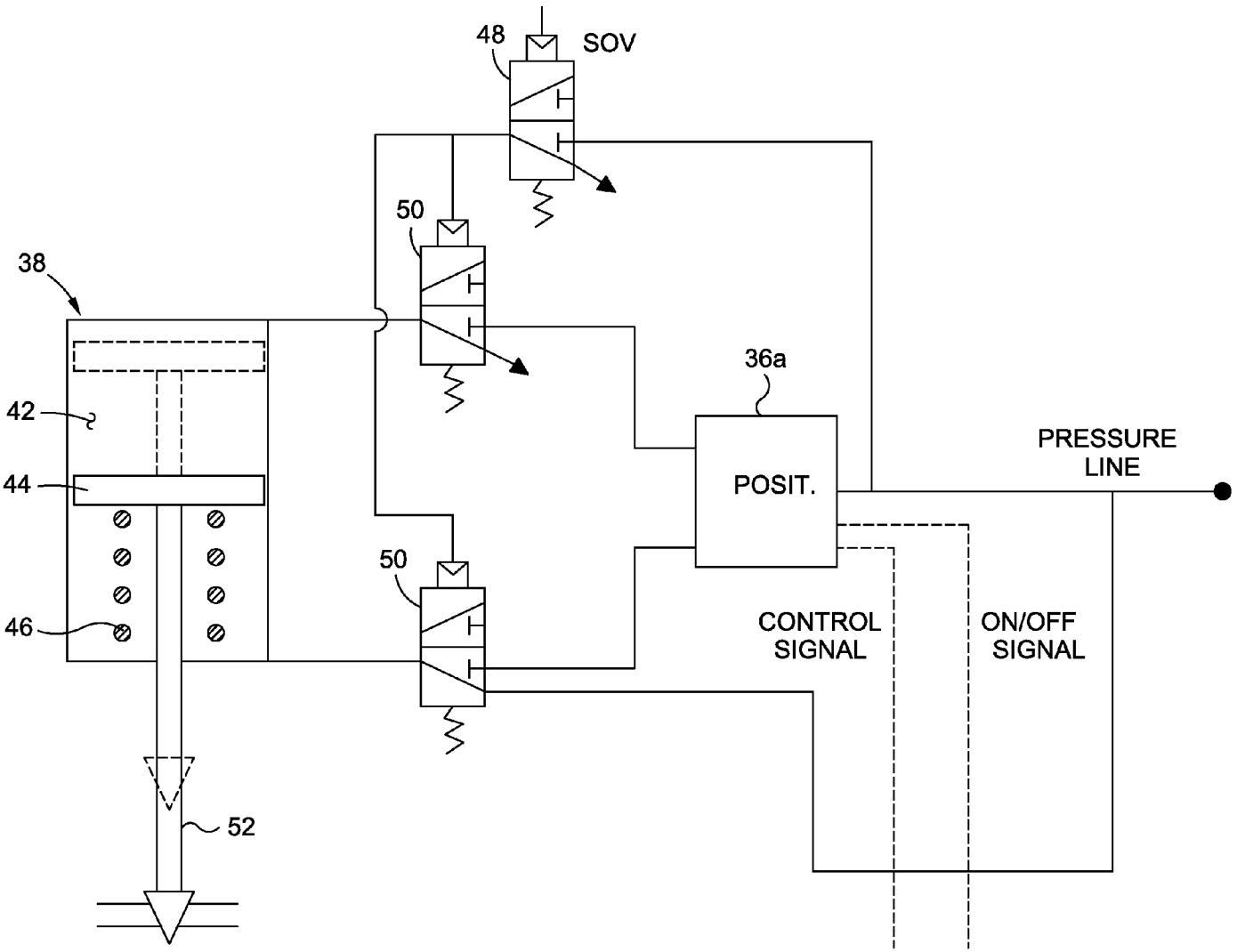
FIG. 5 is a pneumatic schematic for valve actuation embedding SOV driven emergency opening.

FIG. 5 depicts the functionality of a pneumatic actuator 38 with its schematic. The actuator can be of single acting type with spring return 46. The positioner **36*a* drives the air in the actuator chambers 42 separated by a piston 44 or by a membrane depending on the actuator type. When the SOV 48 commands a trip stroke, 3-way valves 50 vent on actuator chamber 42 while pressurizing the opposite chamber to ensure a fast stroke of valve plug 52 independently on the control action taken by the positioner 36*a*. Several schemes exist in industry practice, which might be similar or different from the one shown in FIG. 5**, but they all share similar functionalities with different equipment and accessories.

Per common industry standards, the valve position signal may be an analog current ranging between 4 mA and 20 mA. Although the basic operation of the control system 16 does not require it, the valve position signal can carry a digital signal utilized by the valve positioner 36 for additional functionality. In certain embodiments suitable for deployment in hazardous environments, the valve position signal may also provide electrical power to the control valve system 16 and other associated components, specifically, the valve positioner 36.

The valve position signal can be quantified as a percentage of the fully open or fully closed position of the anti-surge valve 18, and more specifically the pressure of the fluid that is ported to the internal chamber 42 for achieving that position. For example, upon proper calibration, a 0% (4 mA) input signal may be defined as the fully closed position, while a 100% signal (20 mA) may be defined as the fully open position. A 12 mA signal may thus represent a 50% position. Generally, the conversion of the electrical valve position signal to a corresponding pneumatic output is achieved with a transducer.

When the anti-surge valve 18 is in the closed position, the anti-surge valve actuator 38 has a pressure $P_a$ which exceeds the force of the pressure inside the anti-surge valve 18 (tending normally to open the valve plug), in addition to a force able to avoid flow leakage from the inlet to outlet of the anti-surge valve 18 (which is referred to as "seating force"), as well as pressure to compress the return spring(s) 46 of the valve actuator 38, if any.

When the anti-surge valve actuator 38 receives a signal from the valve positioner 36 to open the anti-surge valve 18, the additional "seating force" prevents the immediate movement of the plug. In particular, the pressure $P_a$ within the internal chamber 42 must be discharged before movement of the piston 44 is likely to occur. Therefore, various aspects of the invention relate to anticipating when the internal chamber 42 should be discharged before the request for such movement is made. Such anticipation will allow the anti-surge valve 18 to be ready for movement from the closed position to the open position when the signal is sent to the valve positioner 36.

The anticipated movement of the anti-surge valve 18 from the closed position to the open position is determined based on compressor operational data as measured and analyzed by the surge controller 28. As the operation of the compressor 20, as quantified by the operational data thereof approaches a defined parameter or threshold associated with transitioning of the anti-surge valve 18 from the closed position to the open position, the surge controller 28 may anticipate the timing of the discharge of the internal chamber pressure $P_a$ depending on the position of the working point 22 on the compressor map (FIG. 4), and more specifically on the operative margin 54. The pressure will be discharged to a level that the valve 18 is still closed but it is ready to open promptly. In a double acting piston actuator, a similar objective is achieved by pressuring on chamber while venting the opposite one.

According to one embodiment, a compressor map shows the performance of the compressor 20 with respect to pressure (H), flow rate (Q), and rotating speed ($n_1$, $n_2$, $n_3$). During factory testing of compressors 20, pressure and flow are measured at a range of rotating speeds, and the onset of surge is carefully measured and drawn on a two-dimensional map. This map is then usually non-dimensionalized in order to extrapolate manufacturer test results at different working conditions. In the compressor map depicted in FIG. 4, the surge limit line (SLL) is shown and represents the surge limit for different rotating speeds. Above/left of this line is a region of unstable operation, and operating in this region is to be avoided. During normal compressor operation, the operating point 22 is in the safe operating area, which is that area to the bottom/right of the surge limit line SLL. A surge control line (SCL) is also plotted on the compressor map and is spaced from the surge limit line SLL and positioned within the safe operating area by a difference equal to a control margin.

An operating margin 54 is depicted on the compressor map as the difference between the operating point 22 and the surge control line SCL. The surge controller 28 may monitor the operating margin 54 during operation of the compressor 20 for purposes of identifying impending surge conditions.

Figure 6:
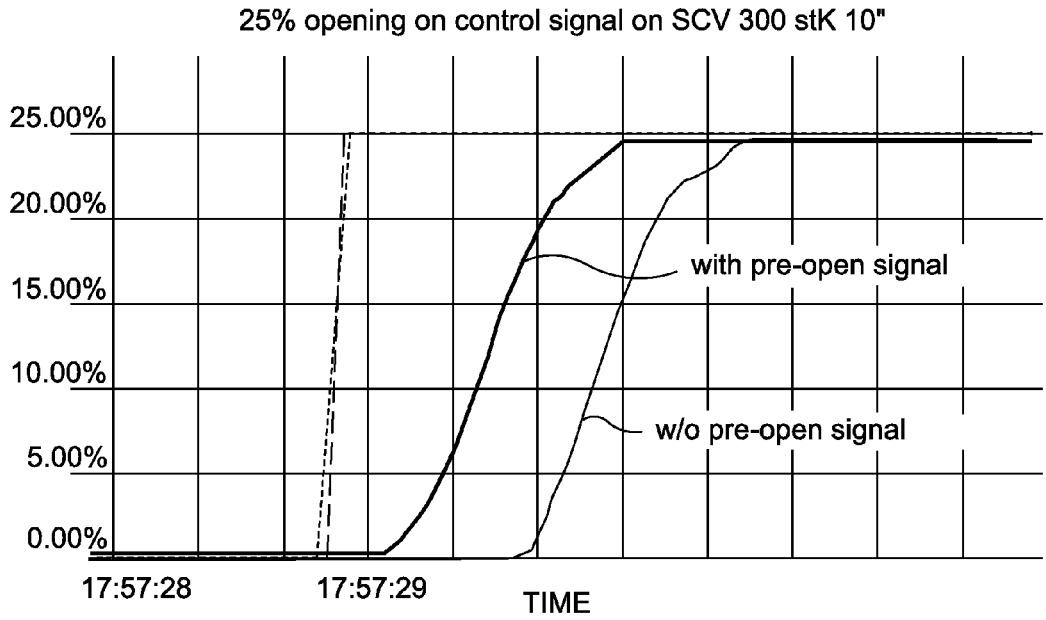
FIG. 6 is the diagram of a laboratory test of a 25% stroke with and without the seat tightness release.
Figure 7:
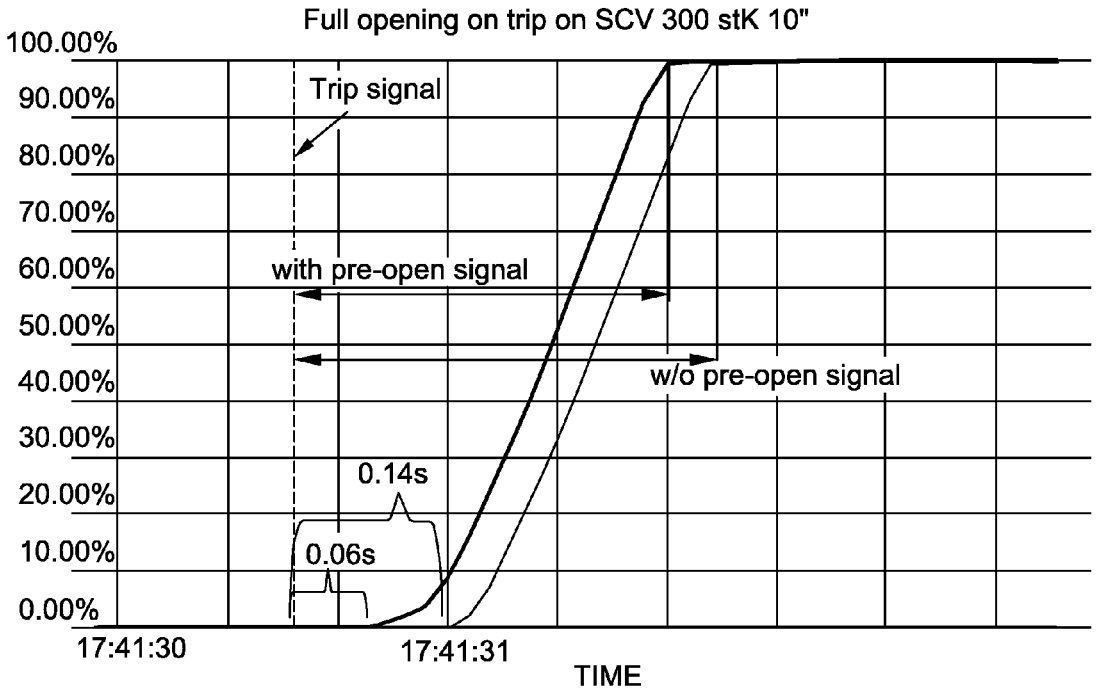
FIG. 7 is the result of a full stroke laboratory test with and without the seat tightness release.
Figure 8:
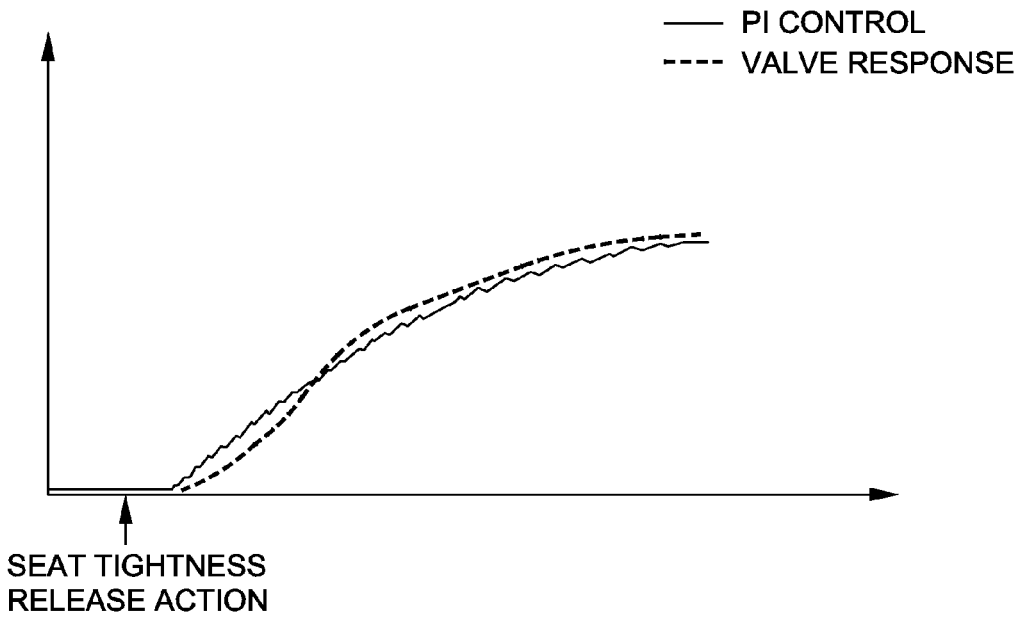
FIG. 8 is the expected valve response in the case the seat tightness is released prior the PI controller asks the valve to smoothly open.
Figure 9:
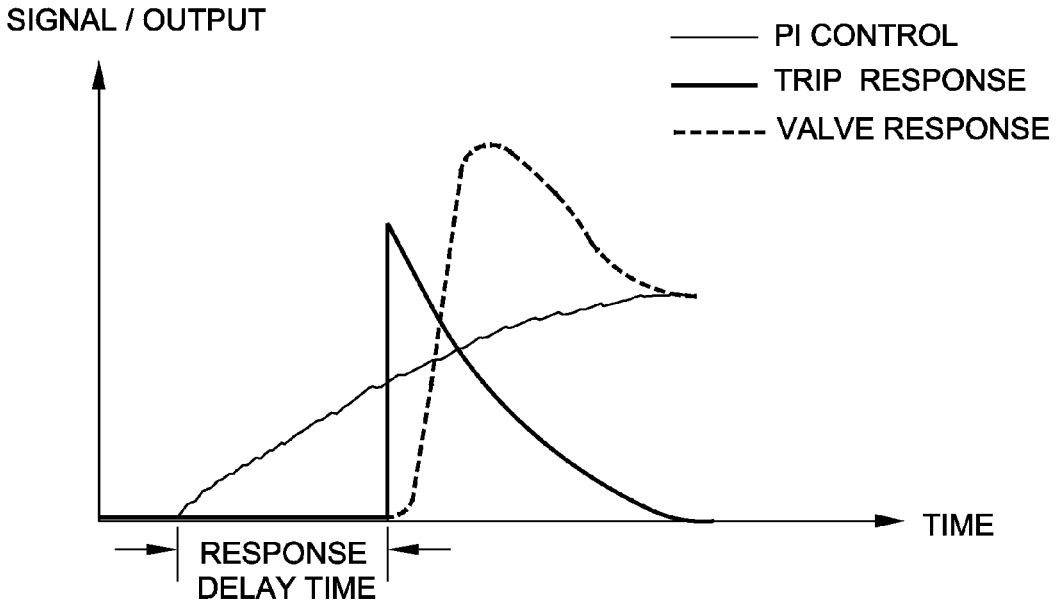
FIG. 9 is the potential behavior of the control loop if the valve response time is not adequate and trip action overrules PI control loop.

According to one implementation of the invention, the surge controller 28 may monitor the magnitude of the operating margin 54 to evaluate potential surge. During safe operation of the compressor 20, the operating point 22 will be safely spaced from the surge control line SCL, and thus, the corresponding magnitude of the operating margin 54 will be relatively high. Conversely, as the operating point 22 moves closer to the surge control line SCL, the magnitude of the operating margin 54 will decrease. Therefore, when the magnitude of the operating margin 54 falls below a preset threshold, the surge controller 28 generates and sends a signal to the valve positioner 36 to discharge the pressure associated with the seating force. Further modifications and refinements as to when the surge controller 28 generates the discharge signal to the valve positioner 36 are also deemed to be within the scope of the present disclosure, as it would be apparent to those having ordinary skill in the art. Thus, the dead time on the seat will be minimized (FIGS. 6 and 7 show an example) and the anti-surge valve 18 will react more promptly to a request to open the anti-surge valve 18, thereby avoiding or minimizing step control. The system response will be likely as depicted in FIG. 8. While in absence of implementation of current invention, the controller will increase the open command to the valve since the delay of the valve represents a control error that has to be overcome by a larger command signal. The valve response concerned with the latter scenario is depicted in FIG. 9.

Whit respect to parameter tuning, the value of the preset threshold largely depends on the system inertia, valve size, valve type and other valve characteristics known in the art.

The valve positioner 36 or digital position controller may be equipped with a high capacity spool (or volume boosters) capable of quickly reducing the pressure inside the anti-surge valve actuator 38 when the movement of the anti-surge valve 18 is about to be required. A level pressure $P_a$ in order to have the valve plug float over the seat may be recorded during valve calibration. In this respect, the valve positioner 36 or digital position controller can be of a smart model that is equipped with actuator pressure sensors.

There are several benefits associated with the anticipated movement of the anti-surge valve 18. For instance, the size and valve capacity thereof may be reduced. If the anti-surge valve opens with a delay, it is understood that the same valve must have more capacity to compensate for the discharge of pressure at compressor discharge. Furthermore, another important benefit in utilizing a more prompt anti-surge valve 18 relates to the most efficient point of operation of the compressor 20 being close to the surge limit line. If the compressor 20 operates close to the surge limit line, the system 16 may achieve energy savings. Yet another benefit to a faster reaction time of the anti-surge valve 18 is that the anti-surge valve 18 may avoid compressor trip, and therefore, downtime of operation.

Figure 10:
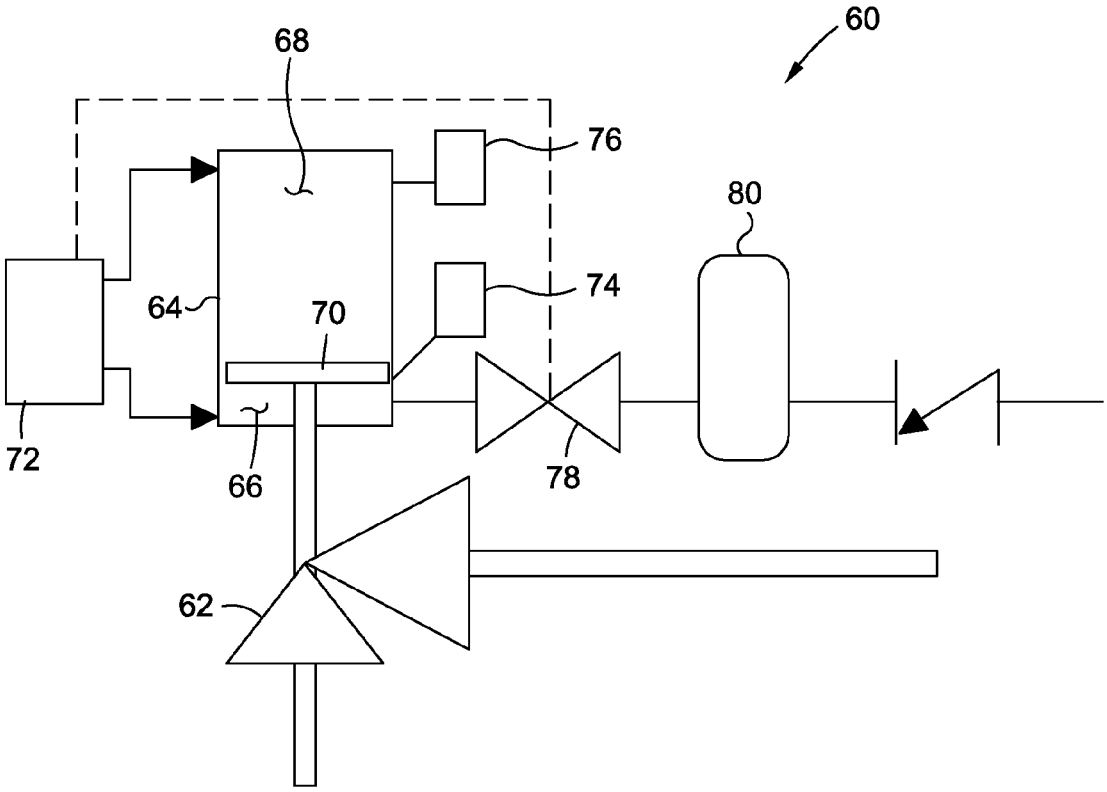
FIG. 10 is a schematic view of another embodiment of a surge control system.

Referring now specifically to FIG. 10, there is depicted another embodiment of an anti-surge valve control system 60 having an anti-surge valve 62 and a corresponding valve actuator 64. The actuator 64 is a double-acting actuator including an actuator housing having an internal chamber segregated into fluidly separate sub-chambers 66, 68. A piston 70 resides within the actuator and divides the internal chamber into the separate sub-chambers 66, 68. The piston 70 is reciprocally moveable within the internal chamber, and is operatively coupled to the anti-surge valve 62 such that the reciprocal movement of the piston causes movement of the anti-surge valve 62 between the closed and open positions.

A positioner 72 controls the movement of the piston by selectively porting/venting fluid into and out of the respective sub-chambers 66, 68. Along these lines, the anti-surge valve control system 60 includes an exhaust/silencer 74 for the bottom sub-chamber 66 and a complementary exhaust/silencer 76 for the upper sub-chamber 68. The exhaust/silencers 76, 78 may be in operative communication with the positioner 72 to receive command signals therefrom.

The anti-surge valve control system 60 additionally includes a quick action, high capacity, electrically operated pneumatic valve, such as a solenoid valve 78. The solenoid valve 78 is in fluid communication with an air tank 80, preferably via large size tubing. A control unit is in operative communication with the solenoid valve 78 and calculates when the solenoid valve 78 is to be opened and for how long it has to stay open (e.g., how many milliseconds).

According to one embodiment, the anti-surge valve control system 60 is designed to feed air from the air tank 80 only to the bottom sub-chamber 66 as an open loop correction of the positioner control. Once this quantity of air is almost completely injected (for example, 90% of what is necessary), the plug is still on the seat and the valve positioner 72 will move the plug according to its own controller.

The particulars shown herein are by way of example only for purposes of illustrative discussion, and are not presented in the cause of providing what is believed to be most useful and readily understood description of the principles and conceptual aspects of the various embodiments a fourth of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An antisurge control system for a compressor which experiences compressor surge in response to defined operational conditions, the compressor having a compressor inlet and a compressor outlet, the antisurge control system comprising:

a processor operatively connectable to the compressor and configured to monitor operation of the compressor and generate an antisurge signal when compressor operational conditions exceed a prescribed threshold associated with compressor surge;

an antisurge valve in operative communication with the processor and fluidly connectable to the compressor inlet and compressor outlet, the antisurge valve being selectively transitional between a closed position and an open position, the antisurge valve being, transitioned from the closed position to the open position to enable fluid flow from the compressor outlet to the compressor inlet through the antisurge valve; and a valve actuator operatively coupled to the processor and the antisurge valve, the valve actuator being configured to exert a first closing force on the antisurge valve for closing the antisurge valve, the valve actuator being configured to exert a second closing force equal to only a portion of the first closing force on the antisurge valve in response to receiving the antisurge signal from the processor, the antisurge valve remaining closed when the valve actuator exerts the second closing force;

the first closing force being equal to a summation of an internal valve force, a seating force, and an actuator biasing force, with:

the internal valve force being associated with a fluid pressure inside the antisurge valve biasing the antisurge valve toward the open position;

the seating force being associated with a pressure required to mitigate flow leakage through the antisurge valve;

the actuator biasing force being associated with a force biasing the actuator toward a position corresponding to the open position of the antisurge valve; and the difference between the first closing force and the second closing force being equal to the seating force.

2. The antisurge control system recited in claim 1, further comprising a flow transmitter operatively coupled to the processor and fluidly connectable with at least one of the compressor inlet and compressor outlet, the flow transmitter being configured to monitor fluid flow through the compressor and transmit corresponding flow data to the processor.

3. The antisurge control system recited in claim 1, further comprising a inlet pressure sensor operatively coupled to the processor and fluidly connectable with the compressor inlet, the inlet pressure sensor being configured to monitor fluid pressure at the compressor inlet and transmit corresponding inlet pressure data to the processor.

4. The antisurge control system recited in claim 1, further comprising a outlet pressure sensor operatively coupled to the processor and fluidly connectable with the compressor outlet, the outlet pressure sensor being configured to monitor fluid pressure at the compressor outlet and transmit corresponding outlet pressure data to the surge processor.

5. The antisurge control system recited in claim 1, wherein the valve actuator includes an actuator chamber and an actuator piston reciprocally moveable within the actuator chamber, movement of the actuator piston corresponding to transitioning of the antisurge valve between the closed and open positions.

6. The antisurge control system recited in claim 5, wherein the valve actuator includes a spring operatively coupled to the piston to urge the piston toward a position corresponding to the open position of the antisurge valve.

7. The antisurge control system recited in claim 5, further comprising:

a valve positioner in operative communication with the valve actuator and the processor, the valve positioner being configured to modify pressure with the actuator chamber for moving the actuator piston.

8. A method of controlling a surge in a compressor, the method comprising the steps of:

providing an antisurge valve in fluid communication with a compressor inlet and a compressor outlet, the antisurge valve being selectively transitional between a closed position and an open position, the antisurge valve being transitioned from the closed position to the open position to enable fluid flow from the compressor outlet to the compressor inlet through the antisurge valve;

monitoring operation of the compressor and identifying an anticipated surge condition by comparing compressor operational conditions with a prescribed threshold associated with compressor surge, the anticipated surge condition being identified when the compressor operational conditions exceed the prescribed threshold associated with compressor surge;

exerting a closing force on the antisurge valve via a valve actuator so as to maintain the antisurge valve in the closed position during normal operation of the compressor, the closing force being associated with:

a fluid pressure inside the antisurge valve biasing the antisurge valve toward the open position;

a pressure required to mitigate flow leakage through the antisurge valve; and a force biasing the actuator toward a position corresponding to the open position of the antisurge valve;

reducing the closing force by an amount equal to the pressure required to mitigate flow leakage through the antisurge valve in response to identification of the anticipated surge condition, the reduced closing force being sufficient to prevent the antisurge valve from transitioning to the open position.

9. The method recited in claim 8, wherein the monitoring step includes monitoring fluid flow through the compressor.

10. The method recited in claim 8 wherein the monitoring step includes monitoring fluid pressure at the compressor inlet.

11. The method recited in claim 8, wherein the monitoring step includes monitoring fluid pressure as the compressor outlet.

12. The method recited in claim 8, further comprising:

a valve actuator in operative communication with the antisurge valve, the valve actuator being configured to exert the closing force on the antisurge valve, the valve actuator including an actuator chamber and an actuator piston reciprocally moveable within the actuator chamber, movement of the actuator piston corresponding to transitioning of the antisurge valve between the closed and open positions.

13. The method recited in claim 12, wherein the reducing step includes venting pressure from the actuator chamber.

14. A compressor antisurge control system comprising:

a compressor having a compressor inlet and a compressor outlet, the compressor experiencing compressor surge in response to defined operational conditions;

a processor operatively connected to the compressor and configured to monitor operation of the compressor and generate art antisurge signal when compressor operational conditions exceed a prescribed threshold associated with compressor surge;

an antisurge valve in operative communication with the processor and fluidly connected to the compressor inlet and compressor outlet, the antisurge valve being selectively transitional between a closed position and an open position, the antisurge valve being transitioned from the closed position to the open position to enable fluid flow from the compressor outlet to the compressor inlet through the antisurge valve; and a valve actuator operatively coupled to the processor and the antisurge valve, the valve actuator being configured to exert a first closing force on the antisurge valve for closing the antisurge valve, the valve actuator being configured to exert a second closing force equal to only a portion of the first closing force on the antisurge valve in response to receiving the antisurge signal from the processor, the antisurge valve remaining closed when the valve actuator exerts the second closing force;

the first closing force being equal to a summation of an internal valve force, a seating force, and an actuator biasing force, with:

the internal valve force being associated with a fluid pressure inside the antisurge valve biasing the antisurge valve toward the open position;

the seating force being associated with a pressure required to mitigate flow leakage through the antisurge valve;

the actuator biasing force being associated with force biasing the actuator toward a position corresponding to the open position of the antisurge valve; and the difference between the first closing force and the second closing force being equal to the seating force.

15. The antisurge control system recited in claim 14, further comprising as flow transmitter operatively coupled to the processor and fluidly connected with at least one of the compressor inlet and compressor outlet, the flow transmitter being configured to monitor fluid flow through the compressor and transmit corresponding flow data to the processor.

16. The antisurge control system recited in claim 14, further comprising a inlet pressure sensor operatively coupled to the processor and fluidly connected with the compressor inlet, the inlet pressure sensor being configured to monitor fluid pressure at the compressor inlet and transmit corresponding inlet pressure data to the processor.

17. The antisurge control system recited in claim 14, further comprising a outlet pressure sensor operatively coupled to the processor and fluidly connected with the compressor outlet, the outlet pressure sensor being configured to monitor fluid pressure at the compressor outlet and transmit corresponding outlet pressure data to the processor.

18. The antisurge control system recited in claim 14, wherein the valve actuator includes an actuator chamber and an actuator piston reciprocally moveable within the actuator chamber, movement of the actuator piston corresponding to transitioning of the antisurge valve between the closed and open positions.

19. The antisurge control system recited in claim 1, wherein the valve actuator is pneumatically controlled.

* * * * *